United States Patent [19]

Kraft

[11] Patent Number: 4,906,605

[45] Date of Patent: Mar. 6, 1990

[54] CARBONLESS PAPER PRINTABLE IN ELECTROSTATIC COPIERS

[75] Inventor: Keith A. Kraft, Mendota Heights, Minn.

[73] Assignee: Minnesota Mining and Manufacturing Company, St. Paul, Minn.

[21] Appl. No.: 191,256

[22] Filed: May 6, 1988

[51] Int. Cl.[4] ..... B41M 5/16

[52] U.S. Cl. ..... 503/215; 428/211; 428/342; 428/537.5; 428/914; 503/200

[58] Field of Search ..... 503/200, 45; 428/537.5, 428/94, 211, 342; 427/150, 152

[56] References Cited

U.S. PATENT DOCUMENTS

| | | | |
|---|---|---|---|
| 4,046,404 | 9/1977 | Treier | 428/327 |
| 4,398,954 | 8/1983 | Stolfo | 503/215 |

*Primary Examiner*—Pamela R. Schwartz

*Attorney, Agent, or Firm*—Donald M. Sell; Walter N. Kirn; Gerald F. Chernivec

[57] ABSTRACT

A carbonless copy paper for imaging via electrostatic copiers comprising a paper stock having a basis weight greater than about 18 pounds per ream and containing on at least a portion of a surface thereof a stilt particle-free composition comprising microcapsules, at least 50 volume percent thereof having a size no greater than about 12 microns and at least 95 percent by volume thereof having a size no greater than about 18 microns.

4 Claims, No Drawings

CARBONLESS PAPER PRINTABLE IN ELECTROSTATIC COPIERS

TECHNICAL FIELD

The invention is a carbonless copy paper, and more specifically a defined paper containing capsules coated thereon containing a color precursor, the capsules being of sufficiently small diameter to allow the reduction or elimination of the transfer of conventional toner powder to background areas of the sheet material when imaged in a photocopying apparatus, i.e., specking.

BACKGROUND ART

Carbonless copy papers are those capable of producing an image upon the application of pressure as delivered by an impact device such as a typewriter or printer, or by a stylus such as a pencil or pen. Normally, such papers function by the transfer of a colorless reactant from a donor to a receptor, the receptor containing a coreactant capable of forming a color with the doner material. The conventional construction consists of solutions of dye precursors encapsulated in a shell coated on a donor sheet, with the dye developer being similarly coated on a receptor sheet.

Such papers may be coated with the color precursor on the back (CB), with the color precursor on the back and the color developer on the front of the same sheet (CFB), or with the color developer on the front of the sheet (CF). The separate sheets of the carbonless paper set are combined with the paper being arranged (from top to bottom) in terms of a CB, CFB, and CF, such that in each case a color former and a color developer will be brought into contact when the microcapsules containing the color-forming material are ruptured by pressure application. A variation on the use of CB, CFB, and CF papers is a self-contained (SC) carbonless paper wherein both color former and color developer materials are applied to the same side of a sheet or incorporated into the fiber lattice of the paper itself.

Carbonless papers are widely used in the forms industry. Typically, preprinted forms are compiled into a set or packet such that marking the top form will provide the required number of duplicates. In one instance, the carbonless paper is prepared in precollated sets wherein sheets of various colors and surfaces are packaged in reverse sequence sets wherein the sheets are arranged opposite to their normal functional order. That is, the CF sheet is first in the set with the CB sheet being last, with the required number of CFB sheets therebetween. When the sheets are then printed in a printer which automatically reverses their sequence in the delivery tray, they will end up in the proper functional order for subsequent data entry. Where reversal of the sequence in the delivery tray does not occur, precollated sheets can be arranged in their normal functional order.

Traditionally, carbonless paper forms have been printed by conventional printing techniques, such as offset lithography, etc. With the advent of high speed electrostatic copiers having dependable, high capacity collating systems, has come the natural attempts to print carbonless paper by such techniques. Such attempts have encountered problems because, for example, the base sheets upon which the coatings are to be applied to form carbonless papers conventionally imaged via offset printing do not have sufficient stiffness or sufficiently low sensitivity to machine conditions for curl and moisture control to be handled in the copier processors or sorters.

Yet another problem encountered when using high speed copiers, such as the Xerox 9000 series, is the development of specks of toner powder on the copies after a number of sheets have been printed. Such specking typically arises from photoreceptor spotting by toner particles which have been plasticized due to contact with solvents from ruptured microcapsules. Carbonless paper having microcapsules coated thereon are subject to premature rupture of the capsules when subjected to pressure, and high speed copiers typically apply pressure to the sheets in three separate stages within the machine operation.

The first location is at the feed assembly station. Abrasion and resultant capsule rupture occur due to friction feeding between feed and retard belts and then as the paper is nipped between steel and polymeric rollers. A common mode of contamination at this location is from the buildup of capsule detritus on the steel roll which later can flake off and transfer into the copying machine itself. Such flakes manifest themselves as large irregularly shaped spots on the printed forms, and usually appear after from approximately 20,000 to 40,000 copies have been run on the machine.

The second location is at the toner transfer site; the paper travels between a photoreceptor belt and a bias transfer roll where it is subject to sheer and pressure forces. It is thus important to have the copying machine in proper adjustment at this location to minimize such forces, which are obviously particularly detrimental to capsule integrity.

Rupture causes release of the encapsulated solution of the color precursor; the released solvent thus wets the surface of the bias transfer roll, thus coming in contact with toner. Such toners are typically made of a pigment such as carbon black in a polymer such as a styrene-butyl methacrylate copolymer. Such materials can be readily plasticized by the color precursor solvent to a soft tacky state. This causes the plasticized toner to adhere and transfer to the selenium photoreceptor, thence the paper in background areas to form specks of about 200 to 300 microns in diameter.

The third location where pressure is applied to the paper during the printing process is at the heat/pressure fixation station. Here the surface temperature of the paper reaches about 160° F. and the pressure is believed to be about 1200 psi, which pressure can again cause capsule rupture, with resultant reduced performance of the carbonless system.

Yet another problem encountered with carbonless paper in imaging via high speed copiers is lint and paper dust which may act as a nucleus for toner transfer in background areas.

Treier, in U.S. Pat. No. 4,046,404, assigned to Xerox Corp., teaches the use of hollow spheres dispersed within the paper to increase the stiffness and caliper thereof when a carbonless paper substrate is sought. His effort is directed to making light weight paper, rejecting the use of heavier basis weight stock. Furthermore, his coating formulation includes starch granules as a cushioning agent in the capsule-containing coating, designed to protect or cushion the imaging capsules to prevent their premature breaking.

Stolfo, in U.S. Pat. No. 4,398,954, was particularly concerned with the oil contamination of the transfer roll in a copier; he incorporated finely divided oleophilic silica with the capsule coating on the donor sheet.

The silica apparently adsorbed the solvents released when capsules ruptured inadvertently. He also teaches the inclusion of starch particles to act as a cushioning agent to minimize capsule rupture (often termed "stilt" material). He also recognized the importance of capsule size in reducing the risk of capsule breakage and the deleterious release of oil to afford contamination within the copier. Thus, he discloses the use of a mean capsule size of approximately 4 microns.

A satisfactory solution to the foregoing problems still has not been found, however, as evidenced by Xerox Corp. publications.

I have now discovered that the foregoing problems can surprisingly be resolved through the use of high basis weight bond paper coated with small capsules, without the necessity of any cushioning or stilt material, and without the necessity for addition of a material to adsorb oil released when inadvertent rupture of capsules occurs. Despite the use of small capsules and high basis weight bond paper, the images formed upon application of pressure are dense and readily legible.

SUMMARY OF THE INVENTION

In accordance with the invention there is provided a carbonless copy paper comprising a paper stock having a basis weight of greater than about 18 pounds per ream and containing on at least a portion of a surface thereof a stilt particle-free composition comprising microcapsules, at least 50 volume percent thereof having a size no greater than about 12 microns and at least 95 percent by volume thereof having a size no greater than about 18 microns.

This construction is capable of being imaged by electrostatic copiers without the specking problem illustrated by prior art carbonless papers.

DETAILED DESCRIPTION OF THE INVENTION

Carbonless paper capsules containing a solution of a color precursor have been described in numerous patents. For example, U.S. Pat. No. 4,334,015 describes the use of urea-formaldehyde capsules in a size range of from 1 to 50 microns; U.S. Pat. No. 4,201,404 discloses melamine-urea-formaldehyde condensation polymer shells in a size range between 10 and 15 microns. This latter reference teaches that when the average capsule size is less than about 10 microns, the capsules are generally harder to break and provide poorer imaging characteristics.

In the present invention, I have discovered that the 50 percent by volume capsule size should be less than about 12 microns, and preferably less than about 10 microns, with the 95 percent by volume size being less than about 18 microns. Furthermore, while it has been customary to add larger particles in CB coatings to act as cushioning or stilt material, I have found that such particles, especially when in capsule form containing solvent therein, are detrimental for use in electrostatic copier machines.

Carbonless papers are available commercially from a number of sources, and the chemistry used therein is of two general types. In the first instance, the capsules contain a colorless dye precursor such s crystal violet lactone, 3,3-bis(1-ethyl-2-methylindolyl)-3-phthalide, 3-N,N-diethylamino-7-(N,N-dibenzylamino)fluoran, or benzoyl leuco methylene blue. In this case the mating color developer sheet is coated with an acidic clay, a phenolic, or a similar acidic reagent to convert the colorless precursor to its colored form.

In the second instance, the capsules contain a ligand capable of forming a colored coordination compound with a transition metal which has been coated on the mating CF sheet.

It should be pointed out that my invention is useful for either of these imaging chemistries, and is basically not related to the composition of the capsule wall.

The solvents used with carbonless paper manufacture have a variety of performance characteristics which are chosen so as to function with the specific imaging chemistry. For example, the solvent must be capable of dissolving sufficient amounts of the color precursor to form a dense image when the capsules are ruptured and the solution is transferred to the receptor CF sheet, thus the solvent ultimately must provide a transport medium for transfer of the precursor to the CF sheet coated with the color developer; encapsulatable; odorless and non-toxic.

The solubility parameters of the various solvents utilized within the microcapsules have been found to be such, in relation to the surface energy of the bias transfer roll of a copier machine, that they would be expected to wet the bias transfer roll and thus transfer readily to toner powders. Since it has been determined that over 90 percent of the capsules of a size greater than about 16 microns in diameter are broken when utilizing conventional carbonless paper in a high speed copier, the concept of minimization of solvent availability to wet the bias transfer roll within the copying device is a critical factor.

Toner powders used in electrostatic copiers are of several types. In one instance, the toner is based on a copolymer of styrene and butadiene. In another instance, the toner is taught to be based upon a copolymer of styrene and butylmethacrylate. In both instances, the toner powders have a solubility parameter which is sufficiently close to that of the solvents used in carbonless capsule manufacture that a swelling of the toner powders will occur. In fact, the solvents will readily plasticize the toner powders, softening them to the point where they can become adhesive in nature.

In conjunction with the small size capsules and the absence of stilt particles, another element of my invention is the use of a higher basis weight bond paper than is typically used in carbonless papers, i.e., greater than about 18 pounds per ream (consisting of 500 sheets of 17 inch×22 inch paper). Preferably, the basis weight is greater than about 20 pounds, and more preferably, greater than about 22 pounds.

While the use of smaller capsules with their inherently stronger nature may be considered an obvious approach to reduce capsule rupture, such use has been reported in earlier work to lead to low image density on the CF sheets. Using a high basis weight bond paper has been taught to reduce image density, and in fact has been rejected in earlier attempts to provide a carbonless paper printable by electrostatic copiers.

The invention will now be further demonstrated and exemplified by the following non-limiting examples, wherein all parts are by weight unless otherwise specified.

EXAMPLE 1

An 18.5 pound basis weight paper was coated with a capsule slurry to provide a dry coating weight of 1.25 to 1.5 pounds per ream. The capsule slurry was composed of capsules having a 50% by volume size of 11 microns or less and a 95 percent by volume size of less than 18 microns or less, a starch/styrene-butadiene binder and zinc rosinate, with the ratio of capsule to binder of 1.8. The coating solution was applied using an air knife coater to minimize capsule rupture during coating.

A second coated sheet was prepared in an identical manner with the exception that spacer or stilt capsules were added to the coating slurry at a level such that 13.3% by volume of the capsules were stilt. Particle size of the stilt capsules was from about 25 to 40 microns.

Both sheets were mated with a standard CF "Tartan" Brand sheet (commercially available from the 3M Company). The constructions were printed on a Model 9900 electrostatic copier commercially available from the Xerox Corp. After 3,000 copies had been printed on the sheets containing the stilt capsules, specking was visibly noticed. In contrast, 15,000 copies were printed on the sheets without stilt capsules before any specking was visibly noticeable. Rate of image development and ultimate image density were acceptable and similar for both constructions.

These results clearly establish that the elimination of the stilt material reduces specking during printing of the carbonless paper in the electrostatic copier without significant change in rate of image development or ultimate image density.

EXAMPLE 2

The capsule slurry of Example 1 (without containing stilt capsules) was coated on 24 pound basis weight paper instead of the paper of Example 1. The resultant sheet was again mated to a Tartan Brand CF sheet, and the sheets were printed on a Xerox Corp. Model 9790 MICR. More than 30,000 copies were printed without noticeable specking. Rate of image development and ultimate image density were acceptable.

The results clearly illustrate that the absence of stilt material in conjunction with the heavier basis weight provided unmistakable benefit in this experiment, with the image quality remaining surprisingly very good.

What is claimed is:

1. A carbonless copy paper suitable for use in conjunction with a receptor paper to provide a colored image thereon, said carbonless paper comprising a paper stock having a basis weight of greater than about 18 pounds per ream and containing on at least a portion of a surface thereof a stilt particle-free composition comprising microcapsules containing therein a solution of a color precursor, at least 50 volume percent of said microcapsules having a maximum size of about 12 microns, and at least 95 volume percent of said microcapsules having a maximum size of about 18 microns.

2. The paper of claim 1 wherein at least 50 volume percent of said microcapsules have a maximum size of about 10 microns.

3. The paper of claim 1 wherein said paper stock has a basis weight of at least about 20 pounds per ream.

4. The paper of claim 1 wherein said paper stock has a basis weight of at least about 24 pounds per ream.

* * * * *